United States Patent [19]

Quenneville

[11] Patent Number: 5,000,145

[45] Date of Patent: Mar. 19, 1991

[54] COMPRESSION RELEASE RETARDING SYSTEM

[76] Inventor: Raymond N. Quenneville, 249 S. Main St., Suffield, Conn. 06078

[21] Appl. No.: 446,160

[22] Filed: Dec. 5, 1989

[51] Int. Cl.[5] ..... F02D 9/06; F02D 13/04

[52] U.S. Cl. ..... 123/321; 123/90.16

[58] Field of Search ..... 123/90.16, 321, 322

[56] References Cited

U.S. PATENT DOCUMENTS

| | | | |
|---|---|---|---|
| 3,405,699 | 10/1968 | Laas | 123/90.12 |
| 4,423,712 | 1/1984 | Mayne et al. | 123/321 |
| 4,510,900 | 4/1985 | Quenneville | 123/321 |
| 4,655,178 | 4/1987 | Meneely | 123/90.16 |
| 4,706,624 | 11/1987 | Meistrick et al. | 123/321 |
| 4,742,806 | 5/1988 | Tart, Jr. et al. | 123/322 |
| 4,898,128 | 2/1990 | Meneely | 123/321 |

*Primary Examiner*—Tony M. Argenbright
*Assistant Examiner*—Robert E. Mates
*Attorney, Agent, or Firm*—McCormick, Paulding & Huber

[57] ABSTRACT

An improved compression release engine retarder or engine brake stores hydraulic fluid under pressure and then release the fluid at an appropriate time in each engine cycle to displace a slave piston and thereby open the exhaust valves for compression release. In one aspect of the improved brake, the hydraulic fluid is released by a master piston of variable length. The variable length master piston travels a fixed distance to the pressure release point so that the timing of the compression release is precisely controlled and independent of installation and engine component tolerances. In another aspect of the improved brake, an anti-jacking valve ensures that the hydraulic pressure displacing the slave piston and exhaust valves is dissipated thereby preventing the exhaust valves from remaining jacked open. In a further aspect of the improvement, the slave piston establishes and maintains a zero lash clearance with the valve crosshead during braking cycles. A slave piston is also disclosed in which a stroke limiting valve restricts the distance the slave piston can move in one engine cycle.

24 Claims, 8 Drawing Sheets

COMPRESSION RELEASE RETARDING SYSTEM

BACKGROUND OF THE INVENTION

1. Field of the Invention

The present invention relates to compression release retarding or braking systems for internal combustion engines. More particularly, the present invention relates to those retarding systems in which an engine valve is opened at a particular time in the engine cycle to release the compressive energy within the engine cylinder associated with the valve and retard or brake engine operation.

2. Description of the Prior Art

In known engine brakes or retarders of the compression release type, compression in an engine cylinder is released by opening the cylinder exhaust valve(s) when the piston within the cylinder is at or near the top dead center (TDC) of a compression stroke. The engine then acts essentially as an air compressor due to the release of compression, the energy expended by the engine on the compression stroke being lost. This loss of energy converts the engine from a power source into a "brake" having the retarding power approaching the power generating capacity of the engine.

Ideally, a compression release brake should release all of the compressed air in a cylinder at the end of its compressive stroke, thereby dissipating the maximum amount of compressive energy. An ideal brake would also allow the exhaust valve to close almost immediately after compression release so that air is not reingested through the open exhaust valve. In known engine brakes such as disclosed in U.S. Pat. No. 4,706,624 of which I am a co-inventor, the release of compressive energy from a cylinder has been accomplished by hydraulically actuating a slave piston within the brake to force an exhaust valve open. The pressurized hydraulic fluid used to actuate the slave piston is generated by a "master" piston and can be delivered either directly or indirectly to the slave piston.

Directly displacing the slave piston of one cylinder with a master piston has several disadvantages. In such a direct displacement system, the master and slave pistons are connected by a hydraulic circuit so that any displacement of fluid by the master piston displaces the slave piston. The slave piston associated with one engine cylinder is advantageously displaced by a master piston, the lifting cam and pushrod associated with the intake or exhaust valve of a certain other cylinder. The timing and motion of the directly displaced slave piston, however, depart substantially from the ideal. Displacement of the master piston by the comparatively slow rise and long dwell of an exhaust or intake cam dictates that the slave piston start to open the exhaust valve well before TDC of the compressive stroke in order that maximum displacement of the slave piston occur close to TDC. On the other hand, if a mechanical fuel injection system is used on the engine, it is preferable that the master piston be displaced by the fuel injector cam and pushrod of the cylinder with which the slave piston is associated because the lifting motion builds relatively quickly to a maximum near TDC, the approximate time at which the cylinder should be decompressd. The fuel injector cam, however, and mechanical fuel injectors are not found on all engines.

Indirectly displacing the slave piston by a master piston overcomes some of the above disadvantages associated with direct displacement. In an indirect system, the master piston supplies the high pressure hydraulic fluid to an accumulator and then triggers release of the accumulated hydraulic fluid to the slave piston at the appropriate time. Such a braking system is the type disclosed in my U.S. Pat. No. 4,706.624 referenced above. In the patent, an accumulator or plenum containing hydraulic fluid, typically lubrication oil, exerts pressure on one side of a "free" piston. The other side of the free piston is connected via passageways to both the master and slave pistons. The passageway between the free and the slave piston is normally closed by a trigger valve so that there is no direct connection between the master and slave pistons. The initial travel of the master piston forces fluid against the free piston. When the force exerted by the master piston on the one side of the free piston exceeds the opposing force exerted by the plenum fluid on the other side plus a small spring force, the free piston is displaced towards the plenum causing the plenum pressure to rise. At this point, the trigger valve prevents any pressure from reaching the slave piston. After travelling a predetermined distance, the master piston opens the trigger valve and allows a volume of fluid displaced by the motion of the free piston to be discharged to the slave piston. Discharge of sufficient high pressure fluid displaces the slave piston against the exhaust valve and opens the valve.

However, low plenum pressure will not cause a discharge of fluid sufficient to displace the slave piston. The discharged hydraulic fluid is then channeled into the plenum to increase the plenum pressure. Over several engine cycles, the pressure within the plenum increases until a sufficient operative level is reached.

Using the accumulated high pressure fluid and the master piston as a trigger allows an exhaust valve to be opened and closed almost instantaneously at any time. The rapid opening of the exhaust valve approaches the ideal compression release engine brake as discussed above.

In known indirect slave piston displacement systems, a one-piece master piston is used to open the trigger valve. The trigger valve must be opened at the exact time near TDC when the slave piston is to be displaced. The length of the master piston as well as the lash or clearance with the pushrod displacing the master piston must be adjusted and maintained so that the trigger point occurs at the proper time. Due to the inherent tolerances of engine components, it is impossible to determine in advance at what point the pushrod will have moved the master piston far enough for the trigger valve to be allowed to open. As a result the length of the master piston can only be determined and adjusted after the engine brake has been installed on the engine and the pushrod clearance or lash is known. Adjustment of the master piston length is thus necessary.

To ensure that the exhaust valves are opened a correct distance, the lash between the slave piston and the valve crosshead must also be adjusted at installation. Component wear and changes in settings further require that the master and slave piston be adjusted at regular intervals to maintain correct triggering point and lash.

Use of a free piston in conjunctin with a master piston also means that the pressure release is determined solely by the fluid displaced by the master piston travel prior to the trigger valve opening. If insufficient fluid is displaced by the master piston due to wear or misadjustment, the slave piston stoke decreases and braking action diminishes.

Accordingly, a general object of the present invention is to provide a compression release retarding system or engine brake which constitutes an improvement over the prior art.

Another object of the present invention is to provide a compression release retarding system which can be installed on an engine without the need for post-installation adjustment of the master piston.

A more specific object of the present invention is to provide a compression release retarding system in which a slave piston establishes and maintains zero lash clearance with the valve actuating mechanism in the braking mode.

Another object is to provide a compression release retarding system in which the total distance the slave piston can travel per engine cycle is regulated.

Still another object is to provide a compression release retarding system in which the slave piston is prevented from keeping the valves open after the engine cylinder has been decompressed.

It is still another object of this invention to provide a compression release retarding system in which the volume of hydraulic fluid released for the purpose of opening the exhaust valves need not be equal to the volume of fluid accumulated by the master piston travel.

SUMMARY OF THE INVENTION

The present invention resides in an engine retarding system of the compression release type for use on internal combustion engines having intake and exhaust valves associated with the engine cylinders.

In accordance with one aspect of the invention, an improved retarding system uses mechanical means for actuating the intake and exhaust valves in synchronism with the engine combustion cycles and includes a hydraulically actuated slave piston and valve actuator associated with one of the exhaust valves to open the exhaust valve and release compression from the cylinder at a predetermined time in a cycle of engine operation. A hydraulic fluid source supplies a hydraulic fluid at a normal operating pessure to the retarding system when the engine retarding system is set in a braking mode. Hydraulic pressure generating means, such as a master piston, pressurizes a quantity of the hydraulic fluid to an elevated pressure substantially above the normal operating pressure of the hydraulic fluid and applies the pressurized hydraulic fluid at the elevated pressure to the slave piston for actuation of the associated valve. The improvement comprises resilient means for returning the slave piston from an active position, in which the slave piston and valve actuator are placed in contracting relationship by hydraulic fluid from the source when the exhaust valve is closed, to a non-active position in which the slave piston and the valve actuator are not in contacting relationship when the exhaust valve is closed. The resilient means is incapable of overcoming the normal pressure applied to the retarding system by the hydraulic source, whereby the slave piston, valve actuator and associated exhaust valve are urged into contact while the retardiing system is set in the braking mode.

Zero lash thus exists between the slave piston and valve actuator when he retarding system enters the braking mode. Adjustment of the initial lash between the slave piston and valve actuator is unnecessary as the slave piston will, during braking cycles, assume the zero lash position.

In accordance with another aspect of the invention, the improved engine retarding system includes the hydraulically operated slave piston and a master cylinder assembly responsive to the mechanical valve actuating means of the engine. The master cylinder assembly generates from the source of hydraulic fluid at a normal pressure, hydraulic fluid at an elevated pressue to operate the slave piston. The improvement comprises a master cylinder assembly having piston means and a cylinder receiving hydraulic fluid from the source at the normal pressure, The piston means is movable within the cylinder by the mechanical actuating means to generate the hydraulic fluid at the elevated pressure. The piston means is also variably lengthened toward the mechanical valve actuating means in response to the hydraulic fluid at the normal pressure.

The variable length of the piston means compensates for engine component tolerances and allows a constant triggering point to be maintained for compression release irrespective of those tolerances.

In accordance with a further aspect of the invention, the engine retarding system includes a master cylinder means for generating high pressure in the hydraulic fluid from the source and a slave cylinder operated at selected times in the engine cycle by the high pressure hydraulic fluid from the master cylinder means. The retarding system also includes a hydraulic communication link between the slave cylinder and the master cylinder means. The improvement comprises anti-jacking means connected with the hydraulic communication link for releasing excessive hydraulic fluid from the slave piston to the source at times in the engine cycle other than the selected times.

The anti-jacking means ensures that excessive hydraulic fluid is released from the system so that the slave piston does not prevent the exhaust valves from closing and also jack the exhaust valves farther open.

In accordance with still another aspect of the invention, the improved retarding system includes hydraulic pressure generating means and a hydraulically actuated slave piston associated with one of the exhaust valves. The hydraulic pressure generating means pressurizes a quantity of the hydraulic fluid to an elevated pressure that is sufficient to cause the slave piston to open the exhaust valve. The improvement comprises stroke limiting means interposed between the hydraulic pressure generating means and the slave piston. The stroke limiting means limits the quantity of hydraulic fluid delivered to the slave piston to open the associated exhaust valve.

The slave piston travel is thus limited which ensures an incremental lowering of the slave piston into operative contact with the exhaust valve crosshead and a unifrom stroke of the slave piston during braking cycles.

DETAILED DESCRIPTION OF THE PREFERRED EMBODIMENTS

Figure 1:
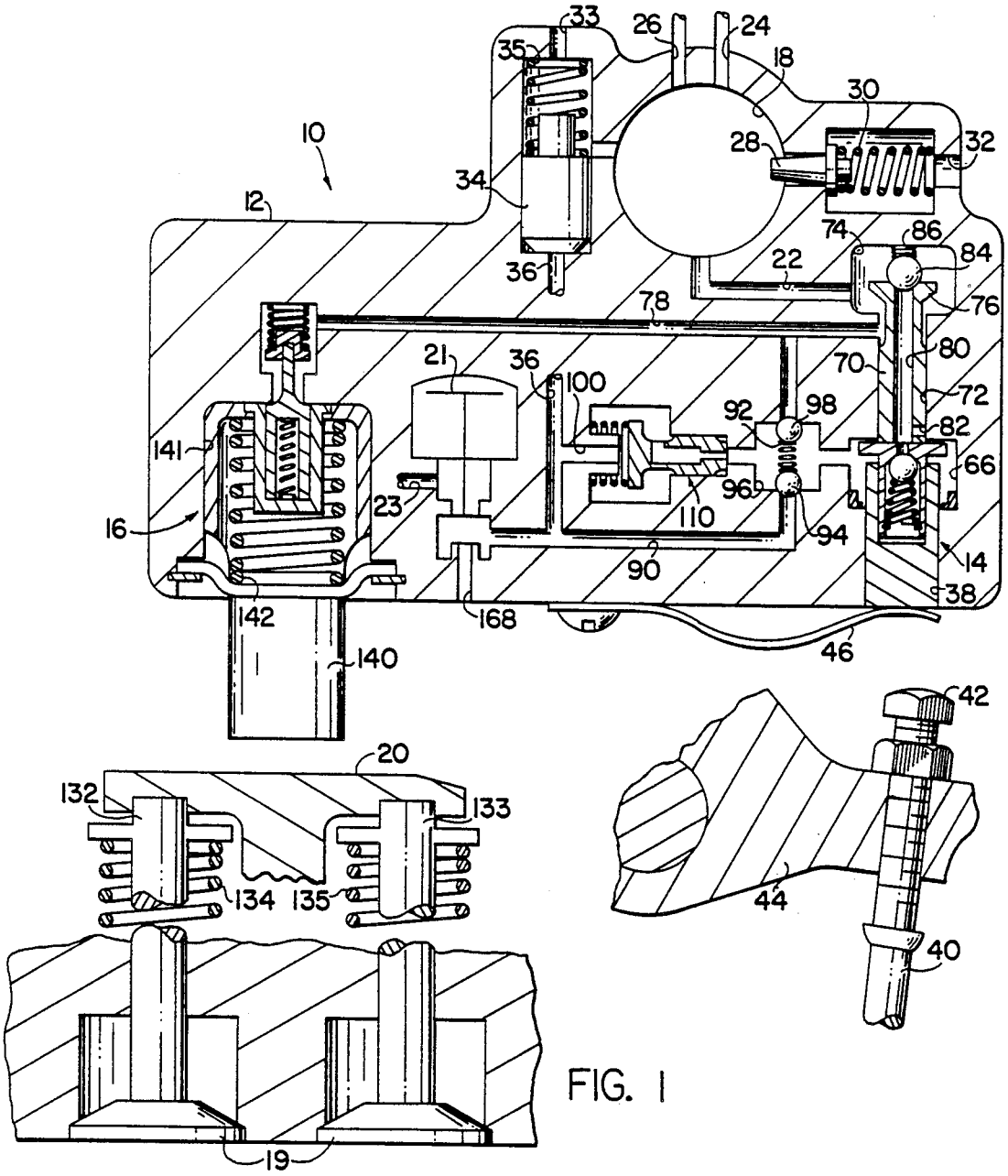
FIG. 1 is a sectional side view of a compression release retarding system or engine brake in accordance with the invention in the non-braking mode or OFF condition.

FIG. 1 shows a compression release engine retarding system, commonly referred to as an engine brake, generally designated 10, in accordance with the invention. The brake 10 has a housing 12 shaped and sized so as to allow the brake 10 to be mounted on an internal combustion engine such as a diesel engine.

The brake 10 includes a master piston assembly 14 and slave piston assembly 16 for each engine cylinder; however, only one of each piston assembly is shown for simplicity. An accumulator 18 serving one or more of the engine cylinders and formed within the brake housing 12 stores pressurized hydraulic fluid, for example, oil from the lubrication system of the engine. At a certain point in its travel, the mastr piston assembly 14 triggers the release of the pressurized hydraulic fluid from the accumulator to the slave piston assembly 16 through the passageway 22. The released fluid drives the slave piston assembly downwards into an exhaust valve crosshead 20 and opens the exhaust valves 19 to release compressed air in the engine cylinder and promote the braking operation.

The master piston assembly 14 is positioned above an adjusting screw 42 in a rocker arm 44 and is reciprocated by a pushrod 40 to pump engine oil as a hydraulic fluid into the accumulator 18. Pushrod 40 and rocker arm 44 could be that of a mechanical fuel injector, or another exhaust valve or intake valve in the engine. In the absence of a mechanical fuel injection system, however, the engine brake 10 must use the motion of an intake or exhaust valve pushrod. The timing of the cyclic motion of intake and exhaust pushrods makes it advantageous to use the pushrod of another cylinder in order that the pressure release from the accumulator 18 and operation of the slave piston be triggered at the correct time near TDC of the engine cylinder in question. For example, for a conventional six cylinder engine the correlation is given in Table 1 below.

TABLE 1

| SLAVE PISTON OF CYLINDER | EXHAUST PUSHROD OF CYLINDER |
|---|---|
| 1 | 2 |
| 2 | 3 |
| 3 | 1 |
| 4 | 6 |
| 5 | 4 |
| 6 | 5 |

Thus, the illustration of the master piston assembly 14, the slave piston 16 in the housing 12 and the associated pushrod 40 and exhaust valves 19 has been distorted for simplicity.

Figure 9:
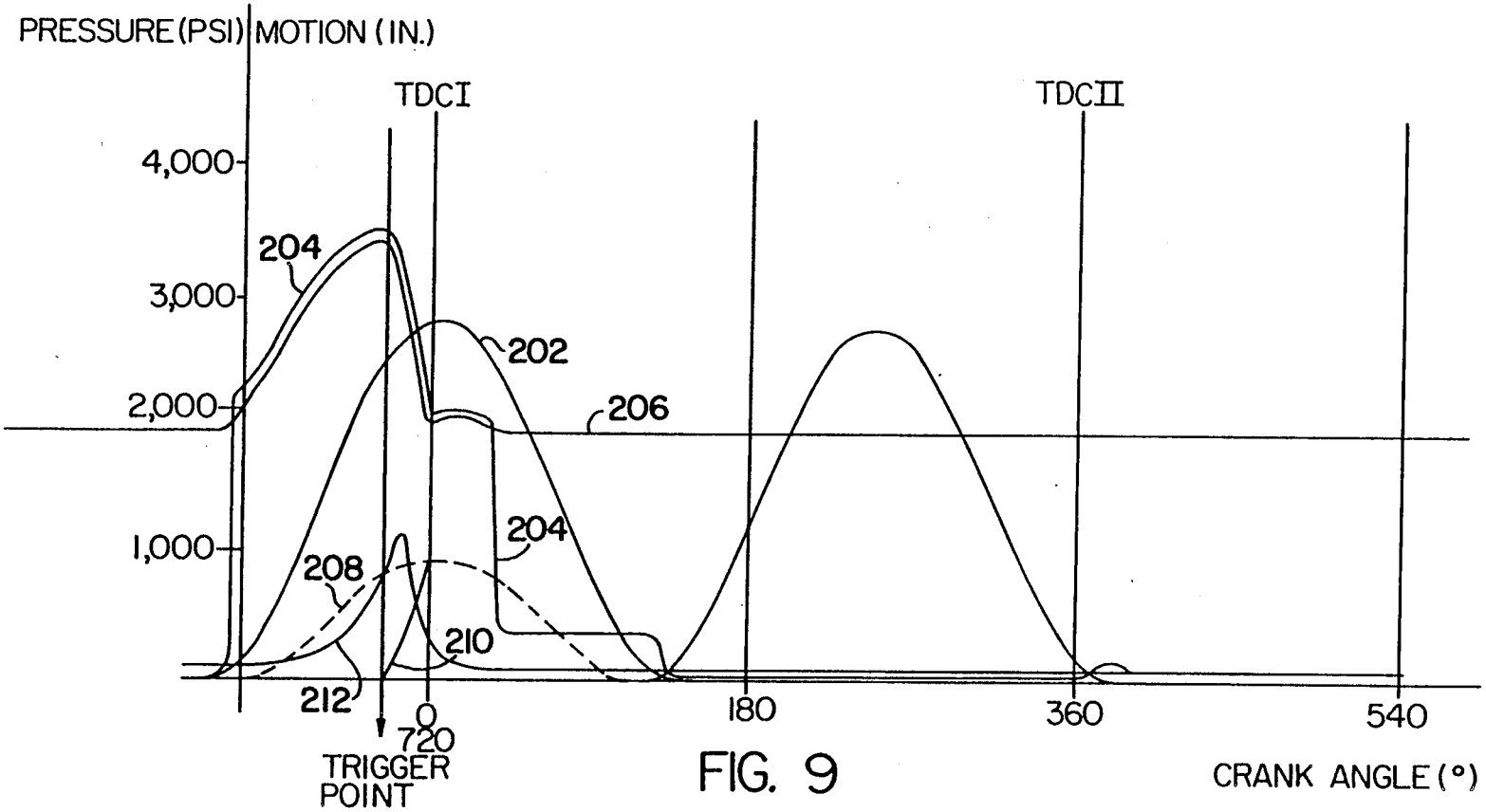
FIG. 9 is a graph illustrating the time relationships between master piston displacement and accumulator and cylinder pressures during approximately one cycle of engine operation.

FIG. 9 is a graph illustrating the pressures and motions of the various elements in the brake 10 as a function of crankshaft angle for approximately one engine cylcle. TDC I represents top dead center when the piston in an engine cylinder in question has completed a compression stroke. TDC II represents top dead center when the piston in the cylinder has completed an exhaust stoke. When the master piston assembly 14 is displaced in accordance with the motion 202 of the pushrod 40, pressure 204 above the master piston assembly 14 increases during the assembly 14 upstroke. Correspondingly, accumulator pressure 206 also increases until the trigger point. The accumulator pressure is then discharged to the slave piston assembly 16 resulting in exhaust valve motion 210 and relieving of the cylinder one pressure 212. The slow response of the exhaust valves resulting from use of a master piston to directly displace a slave piston is shown in curve 208 in contrast to use of the indirect method with an accumulator. The magnitude and appearance of the curves in FIG. 9 are only illustrations of one embodiment of this invention and it should be understood that curves and pressures for other engines and embodiments will vary from those depicted and described herein.

The operation of the brake 10 is advantageously controlled by an electric circuit such as shown in my U.S. Pat. No. 7,706,624 referenced above including for example, a manual ON/OFF switch, a clutch switch and a fuel flow switch for applying the engine brake when desired. The switches are connected to the solenoid 21 in housing 12 and place the brake 10 in a braking mode by actuating the solenoid and allowing entry of lube oil at normal operating pressure (60–100 psi) of the engine lubrication system, or release the brake 10 from the braking mode by deactuating the solenoid and cutting off the supply of oil.

When the system is disabled, the solenoid 21 in FIG. 1 closes passageway 23 so that no lube oil can enter. Any oil in the brake 10 drains to the engine sump via passageway 168. In the absence of lube oil pressure, the master piston assembly 14 is lightly biased away from the rocker arm adjusting screw 42 and toward the top of a master piston cavity 66 by a leaf spring 46.

Figure 2:
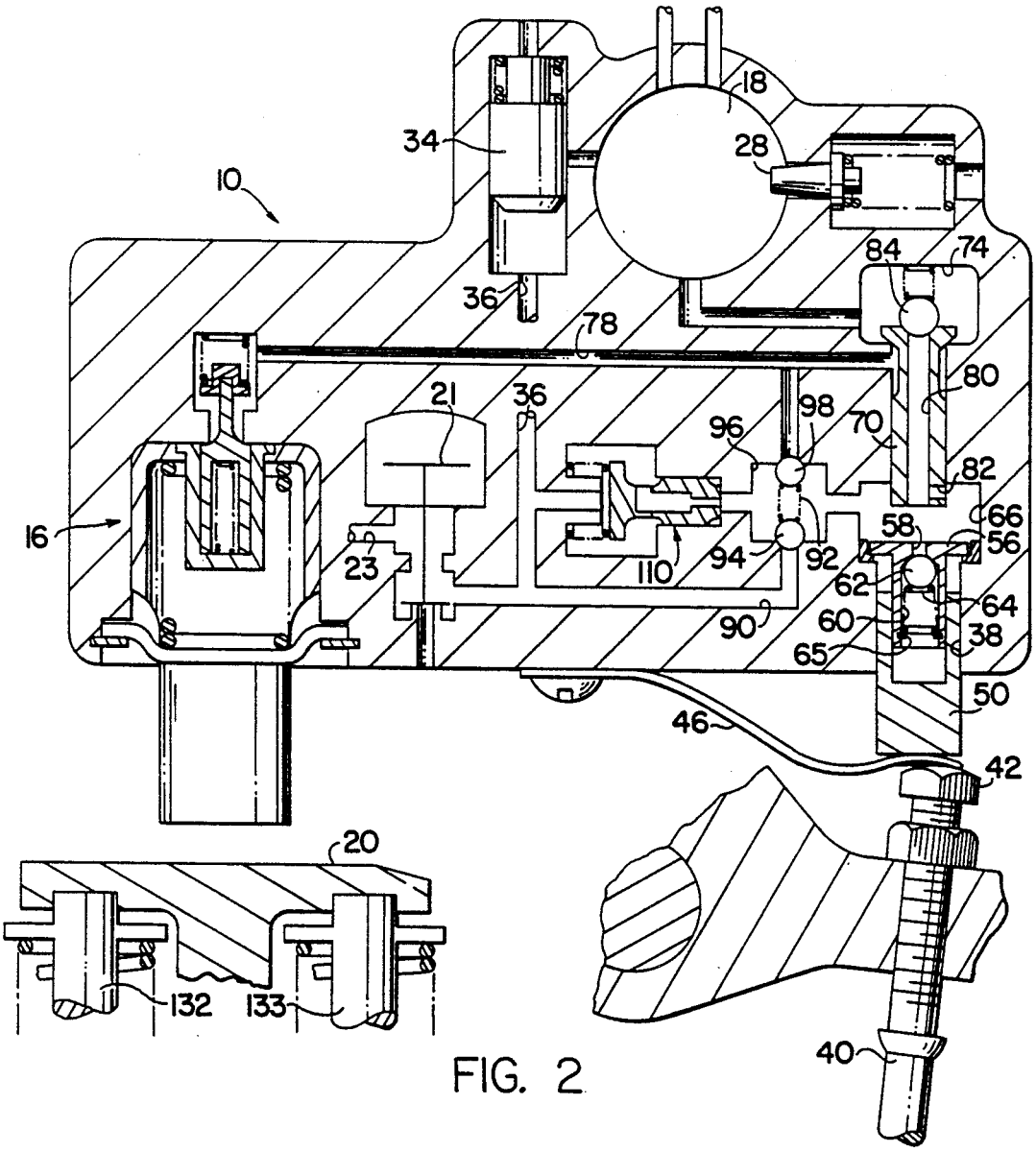
FIG. 2 is another view of the brake of FIG. 1 in the braking mode on ON condition at the beginning of a normal braking operation.

As shown in FIG. 2, when the solenoid 21 is actuated, passageway 168 is blocked and oil enters passageway 90 and overcomes the force exerted by spring 92 to open check valve 94 and flow into the check valve and master piston cavities 96 and 66. Check valve 98 prevents oil from flowing through passageway 78 to the slave piston assembly 16. The lube pressure oil entering cavity 66 overcomes the force exerted by leaf spring 46 and displaces the master piston assembly 14 down toward the bottom of the cavity 66 and into engagement with the adjusting screw 42 and pushrod 40.

Figure 3:
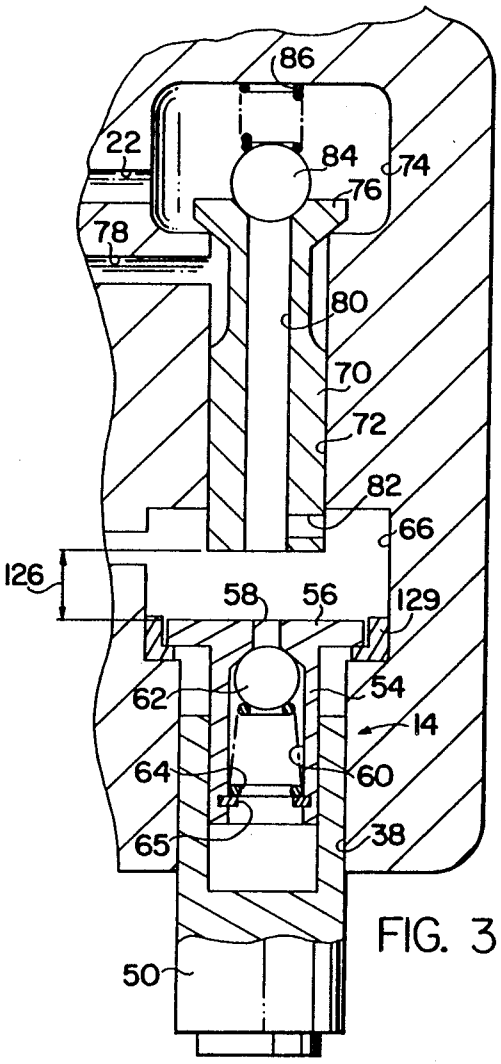
FIG. 3 is a detailed sectional view of the master piston assembly and trigger piston of the engine brake of FIG. 1.

The master piston assembly 14 shown in greater detail in FIG. 3 includes a master piston 50 mounted for reciprocation within a cylinder bore 38 and a secondary piston 54. The master piston has a cylindrical sleeve open at the upper end to telescopically receive the secondary piston 54 and closed at the lower end closest to the pushrod driving the assembly. The secondary piston 54 slides in closely spaced relationship with the inner wall of the master piston 50 sleeve, but is prevented from fully entering cylinder bore 38 by a flange 56. A port 58 extends through the closed end of the secondary piston 54 into the cavity 60 formed by the inner walls of the piston sleeves. A ball check valve 62 can be installed in the piston 54 and is biased by a spring 64 so as to seal the port 58 off from the cavity 60. A retaining clip 65 secures the spring 64 to the inner wall of the secondary piston 54. The port 58 and check valve 62 are optional, but improve the response time of the master piston assembly.

As best seen in FIGS. 2 and 3, the master piston assembly 14 moves downward as a whole under the effects of normal lube oil pressure until flange 56 of the secondary piston 54 contacts the bottom of the master piston cavity 66 at which time, the secondary piston 54 stops moving. Oil continues to flow into the cavity 60 forcing the master piston 50 downwards and away from the secondary piston 54. The master piston 50 continues to move downward until it contacts the adjusting screw 42 on the rocker arm 44. The master piston assembly 14 thus varies its length depending on the height of the rocker arm adjusting screw 42, yet the secondary piston 54 upstroke always starts from the same position at the bottom of cavity 66.

This novel self adjusting feature of the master piston assembly essentially eliminates the complex adjustment procedures between the engine brake 10 and the engine to which it is applied during installation and periodic maintenance inspections. The feature also accommodates variations in the adjustment due to thermal transients and wear.

A trigger piston 70 shown in FIGS. 2 and 3 is slidably mounted to reciprocate in a trigger cylinder bore 72 extending upwardly from the top of master piston cavity 66. A small passageway 82 extends radially from the bore 80 through the wall of piston 70 to the piston cavity 66 for pressure equalization. When the solenoid 21 is turned ON and the master piston assembly moves downwards in cavity 66, the trigger piston 70 is held down against the lube oil pressure by spring 86 of a ball check valve 84 which also closes the bore 80 through the tirgger piston. A flange 76 is seated at the bottom of a trigger cavity 74. The trigger cylinder 72 leads to a trigger cavity 74 which is connected to the accumulator 18 by passageway 22. When the trigger piston 70 is fully displaced downwards as shown and flange 76 is seated, the trigger cavity 74 is sealed from the trigger cylinder bore 72 and passageway 78. When trigger piston 70 is raised so that flange 76 is unseated, the neck of trigger piston beneath the flange 76 provides hydraulic communication via passageway 78 between trigger cavity 74 and the slave piston assembly 16.

With the solenoid 21 actuated, oil flows into and fills the bore 80 in the trigger piston 70, and past check valve 62 in the master piston assembly 14 into the hydraulic lock cavity 60. Oil also flows through the trigger piston bore 80 and past the ball check valve 84 into the trigger cavity 74 and accumulator 18. Since the trigger piston 70 is seated, the trigger cavity 74 and passageway 78 are sealed off from one another and no oil flows to the slave piston assembly 16 from the trigger cavity 74. Check valve 84 closes when the pressure of the oil in the accumulator 18 and trigger cavity 74 approaches the pressure of the oil entering the brake 10.

As shown, the one accumulator 18 serves the master and slave piston assemblies 14 and 16 associated with two other cylinders in the engine via hydraulic passageways 24 and 26 respectively. In a V-6 engine for example, the brake 10 would be mounted on the cylinder head for one bank of cylinders. It is possible in other embodiments however for a brake 10 to have a housing 12 configured so that the brake can bolt onto both engine heads, and one accumulator 18 would service all master and slave piston assemblies 14 and 16. Also, the brake 10 can be used with engines having any number of cylinders arranged in any configuration. A plenum or any other device capable of storing hydraulic fluid under pressure could be used in place of the accumulator 18. The pressurized fluid storage device could also be external and not formed within the housing 12.

Figure 4:
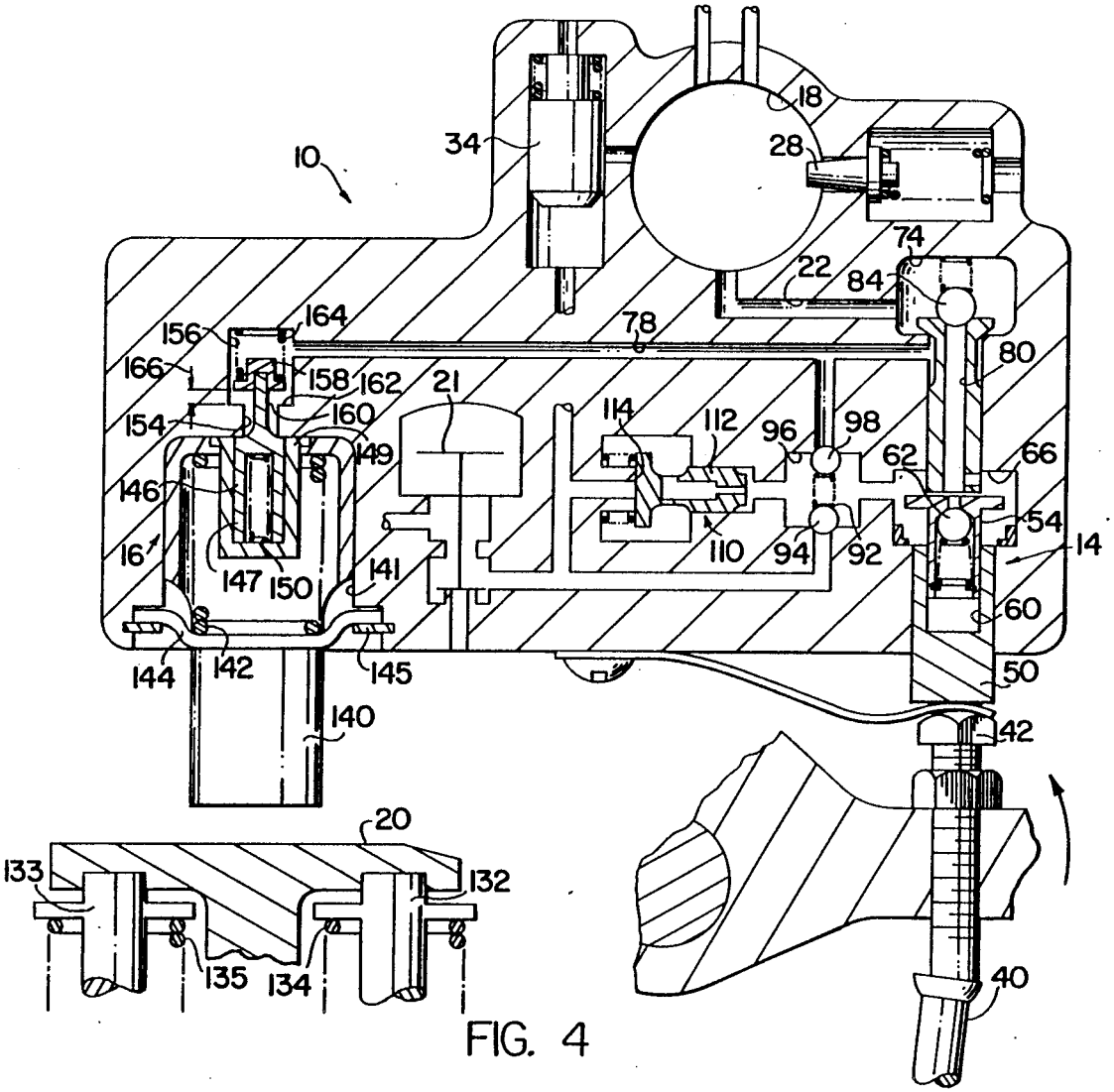
FIG. 4 is a sectional view of the brake of FIG. 1 during accumulator charging.

Referring now to FIG. 4 in which the solenoid 21 is actuated and the first accumulator filling operation is commencing, the brake 10 with the exception of the slave piston assembly 16 has been filled with oil at normal lube pressure. The pushrod 40 and adjusting screw 42 move upward as indicated by the arrow and start to displace the extended master piston 50 and the secondary piston 54 as a unit. The check valve 62 ensures that fluid remains in the hydraulic lock cavity 60, but the check valve 62 and port 58 can be eliminated without changing the unitary effect of the pistons 50 and 54 in the assembly 14. The displacement of the master piston assembly 14 causes the oil pressure to rise in the check valve cavity 96 and the increase in pressure pushes an anti-jacking piston 112 onto its seat 114. As the pushrod 40 and adjusting screw 42 continue to displace the master piston assembly 14 upward, the oil pressure in the master piston cavity 66 and trigger bore 80 increases until the trigger check valve 84 opens and oil is forced into the trigger cavity 74, passageway 22 and the accumulator 18. The oil pressure in the accumulator 18 increases as the upward movement of the master piston assembly 14 continues until the master piston assembly 14 reaches the trigger piston.

Figure 5:
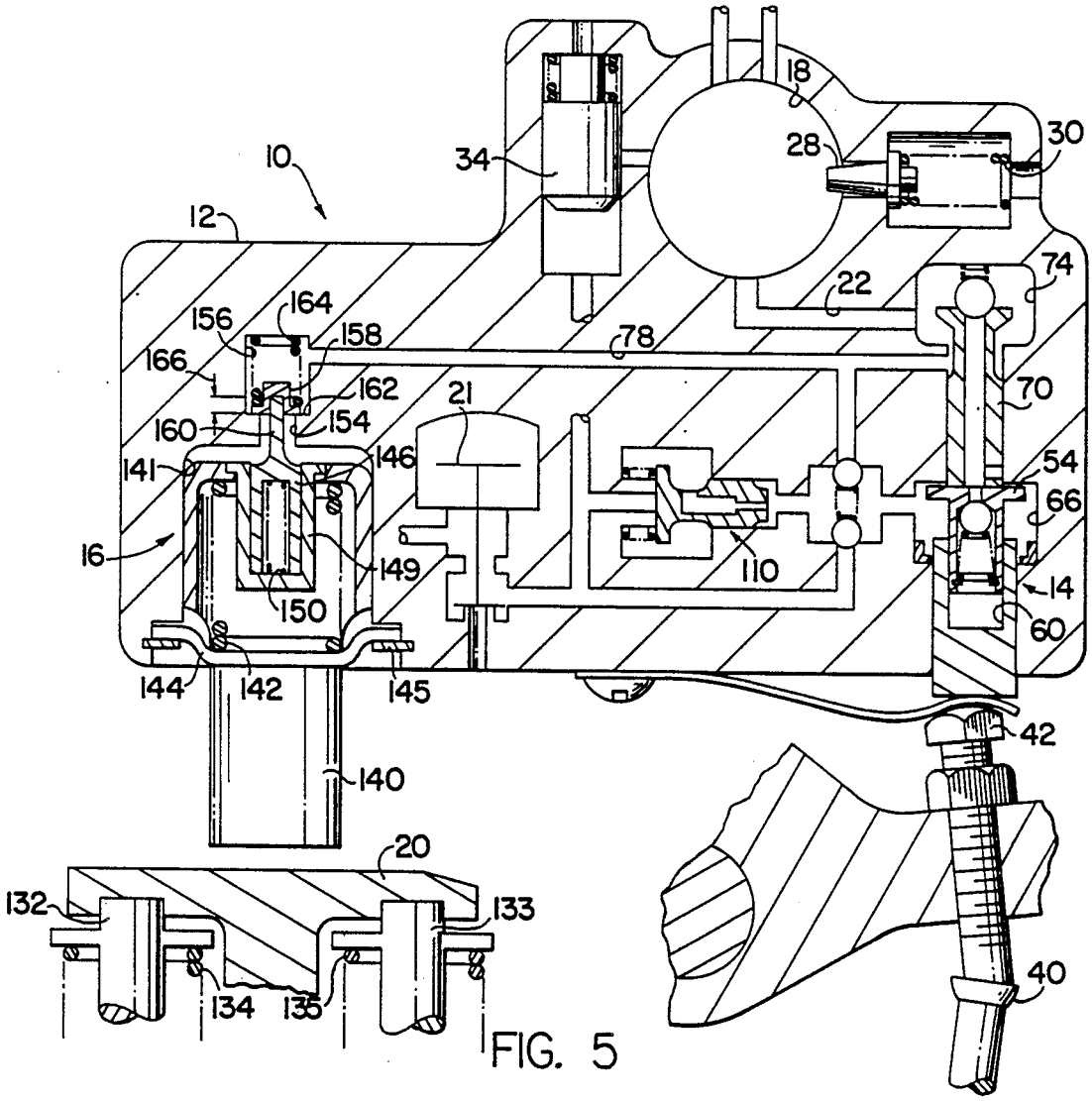
FIG. 5 is sectional view of the brake of FIG. 1 after the triggering point has been reached and a limited displacement of the slave piston has taken place.

Referring now to FIG. 5, the master piston assembly 14 has moved further upward from the FIG. 4 position and has lifted the trigger piston 70 from its seat. The timing point in the engine cycle at which the master piston assembly 14 unseats the trigger piston 70 is determined by the initial gap 126 in FIG. 3 between the seated secondary piston 54 and the trigger piston 70. The gap 126 can be set by setting the length of the trigger piston 70 in manufacture or by using shims 129 to fix the height at which the master piston assembly 14 seats. Any variations in the adjustment or clearance of the rocker arm adjustment screw 42 are irrelevant since the master piston assembly 14 automatically adjusts its length to meet the screw, and the secondary piston 54 travels the same distance 126 irrespective of the screw height. Gap 126 is thus independent of any change in tolerances and can be set in advance of installation at the time of manufacture. During the upward stroke of the master piston assembly 14, the pressure in the hydraulic lock cavity 60 and the master piston cavity 66 are equal (neglecting some small inertial effects) and essentially no leakage occurs through the clearance between the secondary piston 54 and the inner wall of the master piston sleeve. The trigger point is thus unaffected by system leakage.

Several strokes of the master piston assembly 14 may be needed to bring the accumulator up to the pressure needed to effectively lift the exhaust valves. The maximum pressure of the oil in the accumulator is controlled by a pressure relief check valve 28 held closed by a spring 30. Spring 30 allows fluid to escape past pressure relief valve 28 when pressure in the accumulator 18 exceeds a predetermined level. The fluid if supplied from the lubrication system is returned into the engine sump via passageway 32 until the accumulator pressure falls beneath the predetermined level. A dump valve 34 is provided to rapidly depressurize the accumulator 18 when the solenoid 21 is turned OFF. As best seen in FIG. 1, when the solenoid 21 is OFF, the dump valve 34 is in the down position due to lack of oil in passageway 36. As shown in FIG. 2, when the solenoid is turned ON, the presence of lube pressure oil within passageway 36 overcomes spring 35 and raises the dump valve 34 thereby allowing the accumulator 18 to pressurize.

Referring again to FIG. 5, when the trigger piston 70 is lifted off its seat by the master piston assembly 14, oil at a pressure elevated substantially above lube oil pressure, flows from the accumulator 18, through passageway 22 and trigger cavity 74 into passageway 78 toward the slave piston assembly 16.

The slave piston assembly 16 shown in the absence of lube pressure in FIG. 4, is positioned above the exhaust valve crosshead 20. The crosshead 20 is normally supported for reciprocation on a pin (not shown), and is depressed by a rocker arm (not shown) for the engine cylinder in question so as to be able to push down on exhaust valve stems 132 and 133 in opposition to the resistance of valve springs 134 and 135 and the cylinder pressure operating against the exhaust valves to open the valves. A slave piston 140 reciprocates within a cylinder bore 141 and is biased away from the crosshead 20 by a return spring 142 captured by a retainer 144. The retainer 144 passes through a slot in the piston 140 and is secured in the housing 12 by a snap ring 145. The piston 140 can have a slot cut in its lower end so that the exhaust valve rocker arm (not shown) for the cylinder in question can operate the crosshead 20 and valves in the normal course of engine operation. A retainer 149 with a cylindrical bore is press fit into the top of slave piston 140 for a stroke limiting valve 146.

Figure 6:
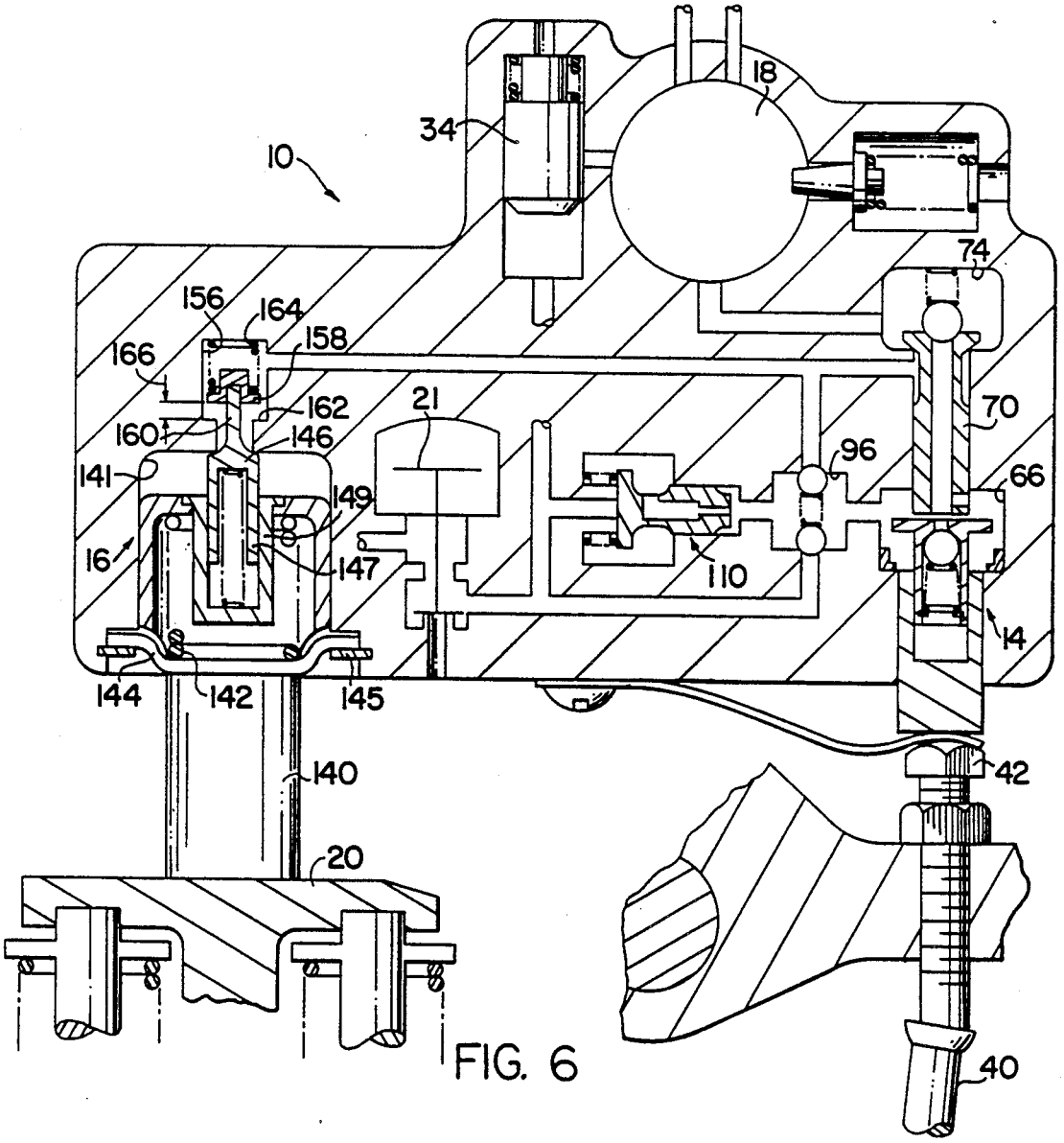
FIG. 6 is another sectional view of the brake of FIG. 1 with the slave piston displaced by an amount sufficient to eliminate the lash clearance.

The stroke limiting valve 146 shown in FIGS. 4 and 6 limits the amount of slave piston displacement and corresponding exhaust valve opening during each engine cycle when the engine brake is ON. In FIG. 4 the valve 146 basically comprises a cylindrical sleeve 147 slidably received in the retainer bore and a hat-shaped poppet 158 within a housing cavity 156. A spring 150 in the sleeve 147 biases the stroke limiting valve 146 away from the slave piston 140. Slave cylinder bore 141 is connected by a bore 154 to the housing cavity 156. The housing cavity 156 connects to the accumulator 18 through passageway 78.

The stem 160 of the stroke limiting valve sleeve 147 extends through the connecting bore 154 and into housing cavity 156, the valve 146 thus being able to reciprocate with respect to bore 154. The poppet 158 attaches to the stem 160 and in conjunction with the seat 162, formed where the bore 154 and the housing cavity 156 meet, during each slave piston displacement serves to check or limit slave piston displacement during each engine cycle by sealing off connecting bore 154 and slave cylinder bore 141 from passageway 78 when the slave piston 146 has moved toward the exhaust valves by a finite amount 166 as shown in FIG. 5. The stroke limiting valve sleeve 147 is fluted just below where it is joined to the stem 160 to prevent the top of the sleeve 147 from sealing off the connecting bore 154 from the slave cylinder 141 when the sleeve 147 presses against the top of the slave cylinder. A spring 164 biases the poppet 158 toward the slave piston 140, but the return spring 142 exerts more force than the spring 150 which in turn exerts more force than the spring 164. The spring 142 cannot overcome the force produced on the slave piston 140 by normal lube oil pressure. Thus only in the absence of oil pressure in passageway 78 will the slave piston 140 and stroke limiting valve 146 assume the positions shown in FIG. 4.

In operation, the first few engine cycles after the solenoid 21 has been actuated by applying the brake, serve to charge the accumulator 18, and eliminate lash between the slave piston 140 and valve crosshead 20 as shown in FIG. 6. When highpressure oil is first released from the accumulator 18 by lifting the trigger piston 70, the oil travels to the housing bore 156 along passageway 78, flows past poppet 158 in the position shown in FIG. 4, through connecting cylinder 154 and into the slave cylinder bore 141 and displaces the slave piston 140 incrementally toward the exhaust valve stems 132, 133. The stroke limiting piston 146 also moves down with assistance from oil pressure on the poppet 158 and the force exerted by the spring 164. The slave assembly 16 continues to move toward the crosshead until the poppet 158 reaches the seat 162 and seals off the slave cylinder 141 from the flow of oil as shown in FIG. 5. At this point, the slave piston 140 will have advanced an increment equal to the distance 166 that the poppet valve 158 is originally offset from the seat 162. It can be seen that by changing the distance 166, the maximum distance that the slave piston 140 advances during one engine cycle can be changed.

After each filling and triggering operation, the oil in passageway 78 and cavity 66 drops to normal lube oil pressure through chamber 96. The slave piston 140 remains in the position it was advanced to during that engine cycle since the spring 142 is incapable of overcoming the normal lube oil pressure acting on the slave piston 140. The spring 150, however, pushes the stroke limiting piston 146 away from the slave piston 140 to the offset position shown in FIG. 6. In effect, the stroke limiting piston 146, retainer 149 and the springs 150, 164 from a self-adjusting linkage between the poppet valve and the slave piston 140 to accommodate lash elimination while retaining the stroke-limiting function. The process of filling, triggering and incrementally displacing the slave piston 140 shown in FIGS. 4–6 is repeated with each subsequent engine cycle. The second and subsequent triggering of pressure from the accumulator 18 generally occurs before the poppet 158 is moved by spring 150 back to the original offset distance 166 from seat 162. Accordingly, subsequent engine cycles do not advance the piston 140 quite as far as the first engine cycle when the brake is turned ON, thus allowing a more gradual elimination of lash between piston 140 and crosshead 20. The incremental displacement of the slave piston 140 to a zero lash position offers the advantage that lash adjustments after installation or component wear are unnecessary.

As shown in FIG. 6, repeated incremental displacement of the slave piston 140 during successive engine cycles eventually brings the piston into contact with the crosshead 20, and may even open the exhaust valves slightly. Then as the elevated oil pressure on the slave piston 140 drops during the latter part of the engine cycle, the valve springs 134 and 135 return the exhaust valves to the closed position and the slave piston 140 holds the zero lash position shown in FIG. 6. Stroke limiting valve 146 and poppet 158 are also moved upwards by the valve springs 134 and 135. Spring 150 further moves the stroke limiting valve 146 and poppet 158 upwards, resulting in poppet 158 being lifted by an amount approximately equal to the offset distance 166. As a result, once the piston 140 has reached zero lash in a braking operation, the spring 150 is able to return valve 146 to a position where the poppet 158 is at the full stroke distance from the seat 162.

As pushrod 40 and adjustment screw 42 execute the next downstroke, gravity and fluid pressure within the master piston cavity 66 force the master piston assembly 14 downwards and the trigger piston 70 seats (at about 20 degrees after TDC).

Figure 7:
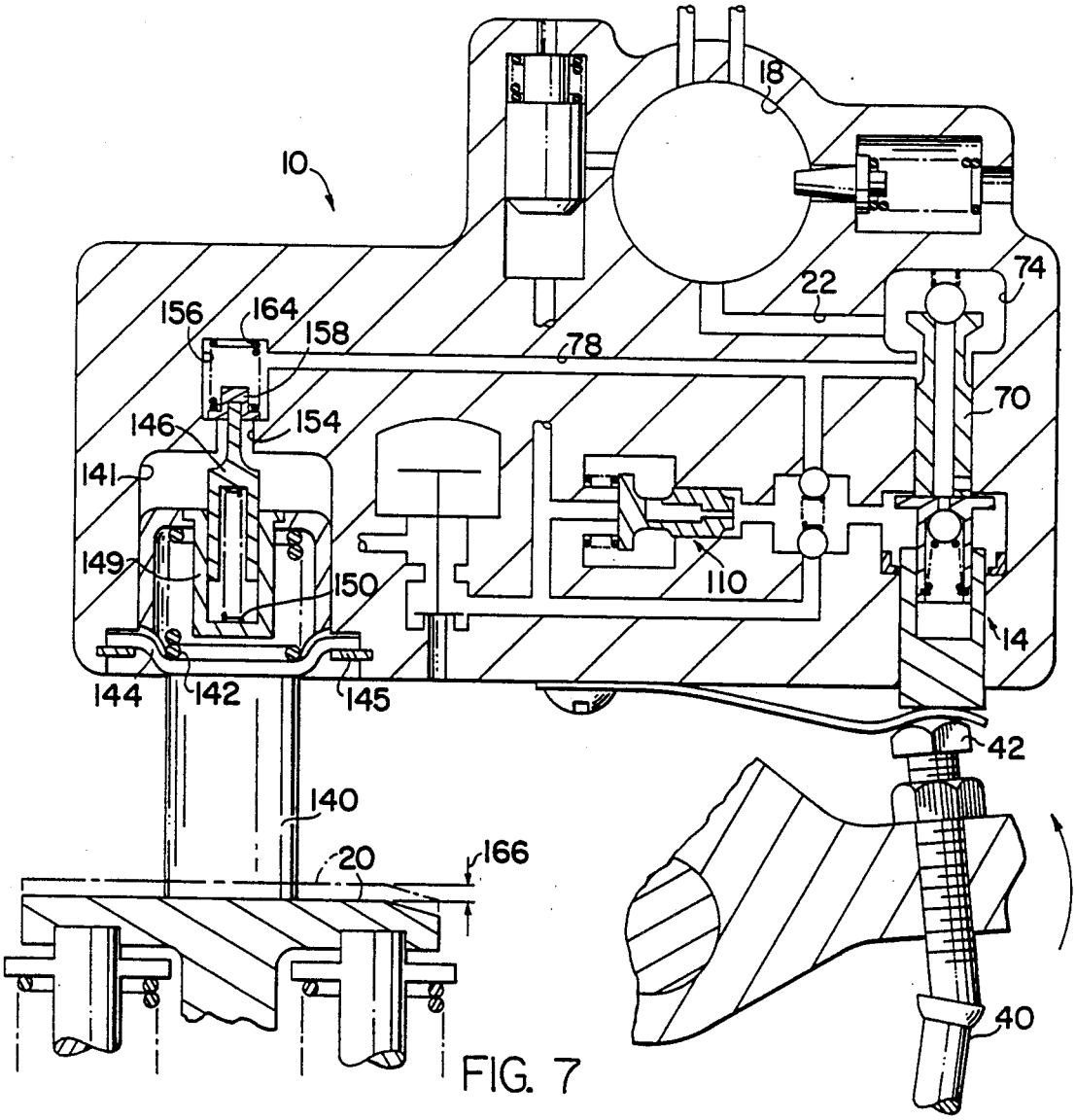
FIG. 7 is another view of the brake of FIG. 6 after the slave piston has been further displaced and has forced the exhaust valves open by a predetermied amount.

As shown in FIG. 7, pushrod 40 next commences its upstroke and displaces the master piston assembly 14 upwards, producing substantially the same effect as discussed before, the pressure in the accumulator 18 now increasing however to 3000–3500 PSI since the master piston assembly 14 can displace more oil than is utilized in each incremental displacement of the slave piston assembly 16. As the pushrod completes its upstroke, the master piston assembly 14 unseats the trigger piston 70 and allows oil at the elevated accumulator pressure to flow from the accumulator 18 and travel through passageway 78 to the slave piston assembly 16. The released oil rapidly displaces the slave piston 140 and the crosshead 20 through the limited stroke distance 166, thus fully opening the exhaust valves and decompressing the engine cylinder.

Figure 8:
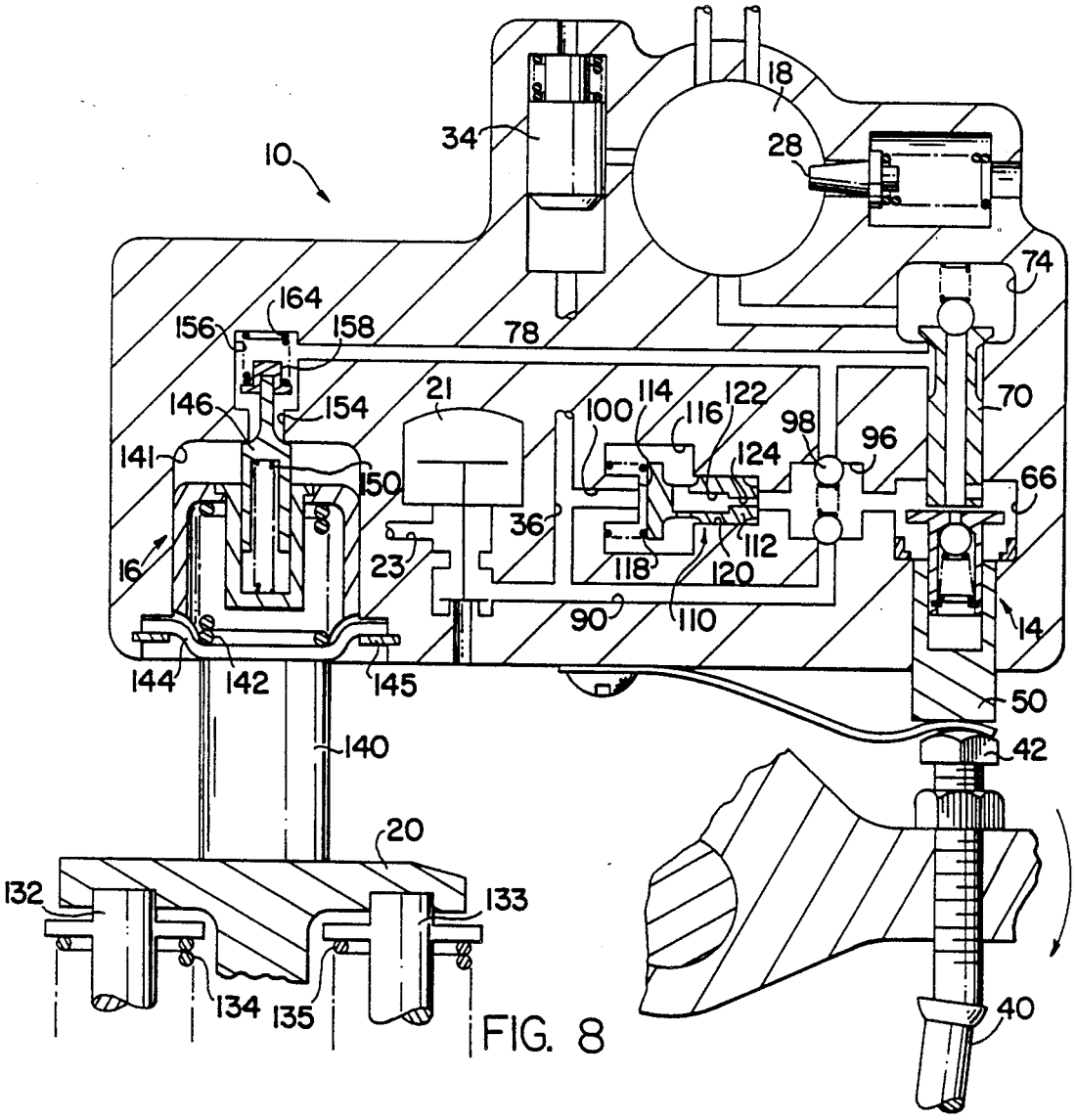
FIG. 8 is another view of the brake of FIG. 7 as the exhaust valves return to the closed position in the course of the braking mode of operation.

Thereafter the pushrod 40 moves downward as seen in FIG. 8 and gravity and normal lube pressure within the master piston cavity 66 again force the trigger piston 70 to seat and the master piston assembly 14 to move downwards. The valve springs 134, 135 acting through the crosshead 20, drive the slave piston 140 up in the zero lash position and displace oil from the slave cylinder bore 141 and housing bore 156 into passageway 78. The displaced oil passes through check valve 98 into the check valve and master piston cavities 96 and 66 and via passageway 100 back into the engine oil supply.

In some engines, particularly those which experience valve floating in an overspeed condition, the rate at which the oil is displaced from the slave piston assembly 16 is not sufficient to return the slave piston 140 to the zero lash position of FIG. 6 before the next engine cycle. The brake 10 would then have an overfill of oil and the slave piston 140 being unable to retract to the zero lash position would keep the exhaust valves jacked open. Significant engine damage could result should the cylinder piston hit the open exhaust valves.

To prevent the valves from remaining jacked open, an anti-jacking valve 110 detailed in FIG. 8 is advantageously included in the brake 10 to provide a direct path for excess oil to flow back to the engine lube system. The anti-jacking valve allows any excess oil entering brake 10 between accumulator charging operations to escape during the dwell period. The anti-jacking valve 110 consists of piston 112 reciprocating within cylinder 120. A spring 118 biases the piston 112 away from seat 114 when the oil pressure in cavity 96 is less than 400 PSI. The anti-jacking piston 112 is forced onto the seat 114 by the increased pressure caused by master piston assembly 14 during accumulator charging.

After the master piston assembly 14 triggers the release of pressure from the accumulator 18 and moves downward, the anti-jacking valve 110 is opened by spring 118 in response to the drop in pressure in the check valve and master piston cavities 96 and 66. Until the next filling operation the anti-jacking valve 110 provides a direct path for the excess oil to flow back to the lube system via orifice 124, passageway 122, anti-jacking cavity 116 and passageways 100, 36 and 23 and thereby prevents the slave piston from keeping the exhaust valves jacked open. The dynamic pressure response of the orifice 124 effectively closes the passageway 122 when master piston assembly 14 is filling the accumulator 18 so that the jacking piston 112 closes the valve 110.

Oil which may leak past slave piston 140 or the master piston 50 is returned to the engine sump along with the oil used to lubricate the rocker assembly. Oil which may leak past the accumulator dump valve 34, the solenoid 21, or the pressure relief valve 28 is also returned to the engine sump.

The pressure delivered to the slave piston assembly 16 from the accumulator 18 is contingent on the pressure stored within the accumulator 18 at the triggering point and not the amount of pressure created by the master piston assembly 14 during its upstroke. It is desirable for the master piston assembly 14 stroke to displace more fluid into the accumulator than is necessary to displace slave piston assembly 16. The accumulator 18 is protected against over pressurization by the pressure relief valve 28. The excess fluid displacement provides a safety margin should the master piston assembly 14 start to wear or leak and displace less fluid. Additionally, if multiple master piston assemblies 14 charge one accumulator 18 and the accumulator then serves multiple slave pistons, the inadequate fluid displaced by one master piston assembly 14 could be compensated for by the excess fluid displaced by the other assemblies 14. As a result, wear and leakage in the master piston assemblies 14 has little or no effect on the brake 10 pressurizing and triggering functions.

When the solenoid 21 is turned OFF to terminate a braking operation, the components of the brake 10 return to the positions depicted in FIG. 1. With the solenoid 21 OFF, the oil in the brake 10 drains to the engine sump via passageway 168. The loss of lube pressure within the passageway 36 causes the accumulator dump valve 34 to move to the down position, allowing the accumulator 18 to vent its internal pressure to the engine sump through passageway 33. The loss of lube pressure in the slave cylinder 141 also allows spring 142 to move the slave piston 140 against the top of the slave cylinder 141. Leaf spring 46 also moves the master piston assembly 14 into a collapsed condition within the master piston cavity 66.

It is to be understood that the invention is not limited to the illustrations described and shown herein, which are merely illustrative of the best modes of carrying out the invention, and which are susceptible to modification in form, size, arrangement of parts and details of operation. For instance, an auxiliary master piston can be used to supplement or replace the pressurizing capabilities of the master and trigger piston assemblies as disclosed hereinabove. Furthermore, the slave piston assembly need not have a lash eliminating feature and could be manually adjustable instead. An anti-jacking valve is desirable but not necessary in most engines and another embodiment without any such anti-jacking valve is possible within the scope of this invention. The invention is thus intended to encompass all such modifications which are within its spirit and scope as defined by the claims.

I claim:

1. In an engine retarding system of the compression release type for use on internal combustion engines having intake and exhaust valves associated with the engine cylinders and mechanical means for actuating the intake and exhaust valves in synchronism with the engine combustion cycles, the retarding system including a hydraulically actuated slave piston and valve actuator associated with one of the exhaust valves to open said exhaust valve at a predetermined time in a cycle of engine operation and release compression from the cylinder, a hydraulic fluid source supplying a hydraulic fluid at a normal operating pressure to the retarding system when the engine retarding system is set in a braking mode, hydraulic pressure generating means for pressurizing a quantity of the hydraulic fluid to an elevated pressure substantially above the normal operating pressure of the hydraulic fluid and applying the pressurized hydraulic fluid at the elevated pressure to the slave piston for actuation of the associated valve, the improvement comprising resilient means for returning the slave piston from an active position, in which the slave piston and valve actuator are placed in contacting relationship when the one of the exhaust valves is closed, to a non-active position in which the slave piston and the valve actuator are not in contacting relationship when the exhaust valve is closed, said resilient means being incapable of overcoming the normal pressure applied to the retarding system by the hydraulic source, whereby the slave piston remains in the active position while the exhaust valve is closed and the retarding system is set in the braking mode.

2. In an engine retarding system, the improvement of claim 1 further including stroke limiting valve means connected in operative relationship with the slave piston for actuating the valve in response to hydraulic fluid from the hydraulic pressure generating means, the stroke limiting means permitting only limited displacement of the slave valve during each cycle of engine operation.

3. In an engine retarding system, the improvement of claim 2 wherein the stroke limiting valve is comprised of a valve poppet and a self-adjusting member connecting the poppet with the slave piston for movement of the poppet with the slave piston, the stroke limiting valve being interposed between the slave piston and the hydraulic pressure generating means to limit the flow of hydraulic fluid to the slave valve with a predetermined movement of the slave piston.

4. In an engine retarding system, the improvement of claim 2 wherein the hydraulic pressure generating means includes a piston assembly for pressuring the quantity of hydraulic fluid, storage means for storing the hydraulic fluid pressurized by the piston assembly and triggering means for releasing the pressurized fluid from the storage means to the slave piston at the predetermined time in the cycle of engine operation.

5. In an engine retarding system, the improvement of claim 1 further including in the retarding system an anti-jacking valve connected between the hydraulic fluid source and the slave piston for controlling the application of hydraulic fluid to the slave piston at the normal operating pressure, and means for actuating the anti-jacking valve to release excessive hydraulic fluid from the slave piston to the hydraulic fluid source when the retarding system is placed in a braking mode and the hydraulic pressure generating means is not applying high pressure hydraulic fluid to the slave piston.

6. In an engine retarding system, the improvement of claim 1 wherein the hydraulic pressure generating means comprises a master piston assembly having a cylinder receiving hydraulic fluid from the source at the normal pressure, and piston means movable within the cylinder by the mechanical actuating means to generate the hydraulic fluid at the elevated pressure and variably lengthened toward the mechanical valve actuating means in response to the hydraulic fluid at the normal pressure.

7. In an engine retarding system, the improvement of claim 5 further including stroke-limiting means connected in operative relationship between the master piston assembly and the slave piston for limiting the displacement of the slave piston by hydraulic fluid from the master piston assembly during each cycle of retarded engine operation.

8. In an engine retarding system of a compression release type for use with internal combustion engines having intake and exhaust valves associated with the engine cylinders, and mechanical means for actuating the intake and exhaust valves in synchronism with the engine combustion cycles, the retarding system including a hydraulically operated slave piston for actuating one of the engine valves at a critical time in the engine combustion cycle, and releasing compression in a cylinder in a braking mode of operation, and a master cylinder assembly responsive to the mechanical valve actuating means of the engine for generating from a source of hydraulic fluid at a normal pressure, hydraulic fluid at an elevated pressure to operate the slave piston, the improvement comprising a master cylinder assembly having a cylinder receiving hydraulic fluid from the source at the normal pressure, and piston means movable within the cylinder by the mechanical actuating means to generate the hydraulic fluid at the elevated pressure and having a variable length to extend toward the mechanical valve actuating means in response to the hydraulic fluid at the normal pressure.

9. In an engine retarding system, the improvement of claim 8 wherein the piston means includes a first piston member being mounted in the cylinder of the assembly to project from the assembly toward the mechanical valve actuating means for actuation thereby, and a second piston member within the cylinder of the assembly and movable with respect to the first piston member to vary the overall length of the two pistons and form between the two members a chamber varying in volume with the varying length of the two members, and the chamber having an opening for admitting hydraulic fluid into the chamber and vary the overall length of the piston members.

10. In an engine retarding system, the improvement of claim 9 wherein the cylinder of the master cylinder assembly includes stop means for limiting the movement of the second piston member toward the mechanical valve actuating means.

11. In an engine retarding system, the improvement of claim 9 wherein a control valve means for releasing the hydraulic fluid at an elevated pressure to the slave piston includes a mechanical actuating member extending from the control valve means into the cylinder of the master cylinder assembly, the second piston member being movable within the cylinder into operative engagement with the actuating member of the control valve means.

12. In an engine retarding system, the improvement of claim 8 further including resilient means for returning the slave piston from an active position in which the slave piston and a valve actuator are placed in contacting relationship by hydraulic fluid from the source when the engine valve is closed, to a non-active position in which the slave piston and the valve actuator are not in contacting relationship when the engine valve is closed, said resilient means being incapable of overcoming the normal pressure applied to the slave piston by the hydraulic source during a braking mode, whereby the slave piston remains in the active position while the engine valve is closed and the retarding system is set in the braking mode.

13. In an engine retarding system, the improvement of claim 12 further including a stroke limiting valve means connected in operative relationship with the slave piston for actuating the valve in response to hydraulic fluid at an elevated pressure from the master piston assembly, the stroke limiting means permitting only limited displacement of the slave valve during each cycle of engine operation.

14. In an engine retarding system of a compression release type for use on an internal combustion engine having intake and exhaust valves associated with the engine cylinders and a hydraulic fluid source, wherein the retarding system includes a master cylinder means for generating high pressure in hydraulic fluid from the source, a slave cylinder operated at selected times in the engine cycle by the high pressure hydraulic fluid from the master cylinder means and a hydraulic communication link between the slave cylinder and the master cylinder means, the improvement comprising anti-jacking means connected with the hydraulic communication link for releasing excessive hydraulic fluid from the slave piston to the source at times in the engine cycle other than said selected times.

15. In an engine retarding system, the improvement of claim 14 wherein the anti-jacking means comprises a pressure responsive valve exposed to pressure generated by the master cylinder means.

16. In an engine retarding system, the improvement of claim 14 wherein the engine further includes mechanical means for actuating the intake and exhaust valves in synchronism with the engine combustion cycles, and the master cylinder means includes a variable length piston assembly with a cylinder receiving hydraulic fluid from the source at a normal pressure to fill the cylinder and lengthen the piston assembly, and piston means being movable within the cylinder means by the mechanical actuating means to generate the hydraulic fluid at the elevated pressure and being variably lengthened toward the mechanical valve actuating means in response to the hydraulic fluid at the normal pressure.

17. In an engine retarding system, the improvement of claim 15 further including resilient means for returning the slave piston from an active position in which the slave piston and a valve actuator and associated engine valve are placed in contacting relationship by hydraulic fluid from the source when the engine valve is closed, to a non-active position in which the slave piston and the valve actuator are not in contacting relationship when the engine valve is closed, said resilient means being incapable of overcoming the normal pressure applied to the slave piston by the hydraulic source during a braking mode, whereby the slave piston remains in the active position while the engine valve is closed and the retarding system is set in the braking mode.

18. In an engine retarding system of the compression release type for use on internal combustion engines having intake and exhaust valves associated with the engine cylinders and the mechanical means for opening and closing the intake and exhaust valves in synchronism with the engine combustion cycles, the retarding system including a hydraulically actuated slave piston associated with one of the exhaust valves and hydraulic pressure generating means for pressurizing a quantity of the hydraulic fluid to an elevated pressure sufficient to cause the slave piston to open the exhaust valve, the improvement comprising a stroke limiting means interposed between the hydraulic pressure generating means and the slave piston for limiting the quantity of hydraulic fluid at an elevated pressure delivered to the slave piston to open the associated exhaust valve.

19. In an engine retarding system, the improvement of claim 18 wherein the stroke limiting means comprises a valve interposed between the hydraulic pressure generating means and the slave piston, the valve having a housing and a valve poppet with a limited stroke within the housing and self-adjusting linkage means interposed between the valve poppet and the slave piston for moving the slave piston by not more than said limited stroke with each movement of the valve poppet regardless of the length of the linkage means between the valve poppet and the slave piston.

20. In an engine retarding system, the improvement of claim 19 wherein the self-adjusting linkage means comprises a piston and cylinder assembly exposed to the hydraulic fluid actuating the slave piston, the piston of the assembly being loosely fitted with the cylinder to allow hydraulic fluid to enter and extend the piston with respect to the cylinder and thereby adjust the length of the linkage between the valve poppet and the slave piston as the slave piston opens the exhaust valve.

21. In an engine retarding system, the improvement of claim 20 wherein the slave piston is mounted within a cylinder having a seat means, and the piston and cylinder assembly of the extendable linkage are limited in extension by the seat means.

22. In an engine retarding system, the improvement of claim 18 wherein the poppet of the stroke limiting valve is mounted within a housing bore with a clearance between the bore and the poppet, and the bore is in fluid communication with the slave piston to deliver hydraulic fluid which moves past the poppet to the slave piston.

23. In an engine retarding system of claim 18 wherein the engine also has a source of hydraulic fluid at a normal pressure, the improvement wherein the hydraulic pressure generating means includes a master piston assembly having a cylinder receiving hydraulic fluid from the source at the normal pressure, and piston means movable within the cylinder by the mechanical actuating means to generate the hydraulic fluid at the elevated pressure and variably lengthened toward the mechanical valve actuating means in response to the hydraulic fluid at the normal pressure.

24. In an engine retarding system of the compression release type, the improvement of claim 18 wherein storage means are provided for storing the quantity of pressurized hydraulic fluid generated by the hydraulic pressure generating means; and triggering means are connected with the storage means and with the engine for releasing the stored, pressurized hydraulic fluid from the storage means to the slave piston at the appropriate time in an engine cycle to open the exhaust valve and produce an engine retarding effect.

* * * * *